US010658782B2

(12) United States Patent
Eckel et al.

(10) Patent No.: US 10,658,782 B2
(45) Date of Patent: May 19, 2020

(54) STOP SPRING FOR A CONTACT DEVICE, ELECTRICAL CONTACT DE-VICE ASSEMBLY AS WELL AS ELECTRICAL CONNECTOR

(71) Applicant: TE Connectivity Germany GmbH, Bensheim (DE)

(72) Inventors: Markus Eckel, Buerstadt (DE); Jochen Fertig, Bensheim (DE); Joachim Toboldt, Fuerth (DE); Wolfgang Balles, Mannheim (DE); Stefan Wallner, Moerlenbach (DE); Ruediger Meier, Neckargemuend (DE)

(73) Assignee: TE Connectivity Germany GmbH, Bensheim (DE)

( * ) Notice: Subject to any disclaimer, the term of this patent is extended or adjusted under 35 U.S.C. 154(b) by 188 days.

(21) Appl. No.: 15/353,217

(22) Filed: Nov. 16, 2016

(65) Prior Publication Data

US 2017/0141503 A1 May 18, 2017

(30) Foreign Application Priority Data

Nov. 16, 2015 (DE) ..... 10 2015 119 723

(51) Int. Cl.
*H01R 13/648* (2006.01)
*H01R 13/426* (2006.01)
*H01R 13/18* (2006.01)

(52) U.S. Cl.
CPC ..... *H01R 13/426* (2013.01); *H01R 13/18* (2013.01); *H01R 2201/26* (2013.01)

(58) Field of Classification Search
CPC ..... H01R 13/62933; H01R 13/6581; H01R 13/187
USPC ... 439/607.04, 310, 271, 579, 589, 485, 856
See application file for complete search history.

(56) References Cited

U.S. PATENT DOCUMENTS 5,431,576 A * 7/1995 Matthews ..... H01R 13/113 439/247
5,607,328 A * 3/1997 Joly ..... H01R 13/11 439/851
6,482,035 B2 * 11/2002 Okabe ..... H01R 4/2433 439/596
6,952,066 B2 10/2005 Burhenne et al.
7,766,706 B2 8/2010 Kawamura et al.
2004/0115961 A1 * 6/2004 Burhenne ..... H02K 5/148 439/13
2015/0011127 A1 1/2015 Ngo
(Continued)

FOREIGN PATENT DOCUMENTS

CN 1497820 A 5/2004
CN 102217142 A 10/2011
CN 104466462 A 3/2015
(Continued)

OTHER PUBLICATIONS

German Office Action, dated Aug. 2, 2016, 12 pages.
(Continued)

*Primary Examiner* — Phuong Chi Thi Nguyen
(74) *Attorney, Agent, or Firm* — Barley Snyder

(57) ABSTRACT

A contact stop spring and contact assembly are disclosed. The contact assembly has a contact housing with a contact chamber and a contact resiliently held in the contact chamber by the contact stop spring.

16 Claims, 6 Drawing Sheets

(56) References Cited

U.S. PATENT DOCUMENTS

2015/0087193 A1* 3/2015 Takane ..... H01R 12/515
439/856

FOREIGN PATENT DOCUMENTS

| | | | |
|---|---|---|---|
| DE | 1908251 | U | 1/1965 |
| DE | 4312641 | A1 | 10/1994 |
| EP | 0159466 | A2 | 10/1985 |
| EP | 0159466 | A3 | 4/1987 |
| FR | 2784507 | A1 | 4/2000 |
| WO | 2010057096 | A1 | 5/2010 |

OTHER PUBLICATIONS

Abstract of DE4312641, dated Oct. 20, 1994, 2 pages.
Abstract of FR2784507, dated Apr. 14, 2000, 1 page.
European Search Report, dated Mar. 13, 2017, 10 pages.
Chinese First Office Action with English translation, Chinese Patent Application No. 201611010185.X, dated May 20, 2019, 23 pages.
Abstract of EP 0159466, dated Oct. 30, 1985, 1 page.
Chinese Second Office Action, Application No. 201611010185.X, dated Mar. 6, 2020, 8 pages.
English translation of Chinese Second Office Action, Application No. 201611010185.X, dated Mar. 6, 2020, 11 pages.

* cited by examiner

STOP SPRING FOR A CONTACT DEVICE, ELECTRICAL CONTACT DE-VICE ASSEMBLY AS WELL AS ELECTRICAL CONNECTOR

CROSS-REFERENCE TO RELATED APPLICATION

This application claims the benefit of the filing date under 35 U.S.C. § 119(a)-(d) of German Patent Application No. 102015119723.5, filed on Nov. 16, 2015.

FIELD OF THE INVENTION

The present invention relates to an electrical contact assembly, and more particularly, to a contact stop spring of an electrical contact assembly.

BACKGROUND

Known electrical connectors must provide a reliable transmission of electrical power, signals, and/or data in a variety of adverse environments, such as within a motor vehicle. A large number of specially configured known connectors are used throughout a spectrum of application conditions. The known connectors may be plug connectors or mounted connectors.

In an environment with high vibration stresses, as can arise in a vehicle, for example, the vibration can cause relative movement between the contacts of a connector and of a mating connector, for example, movement between a bushing contact and a tab contact of an electrical plug connection. Movement can be introduced into an electrical contact assembly between the connector and the mating connector in particular through a moved electrical line connected to the connector.

SUMMARY

An object of the invention, among others, is to provide an electrical contact assembly with reduced movement. The disclosed contact assembly has a contact housing with a contact chamber and a contact resiliently held in the contact chamber by a contact stop spring.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
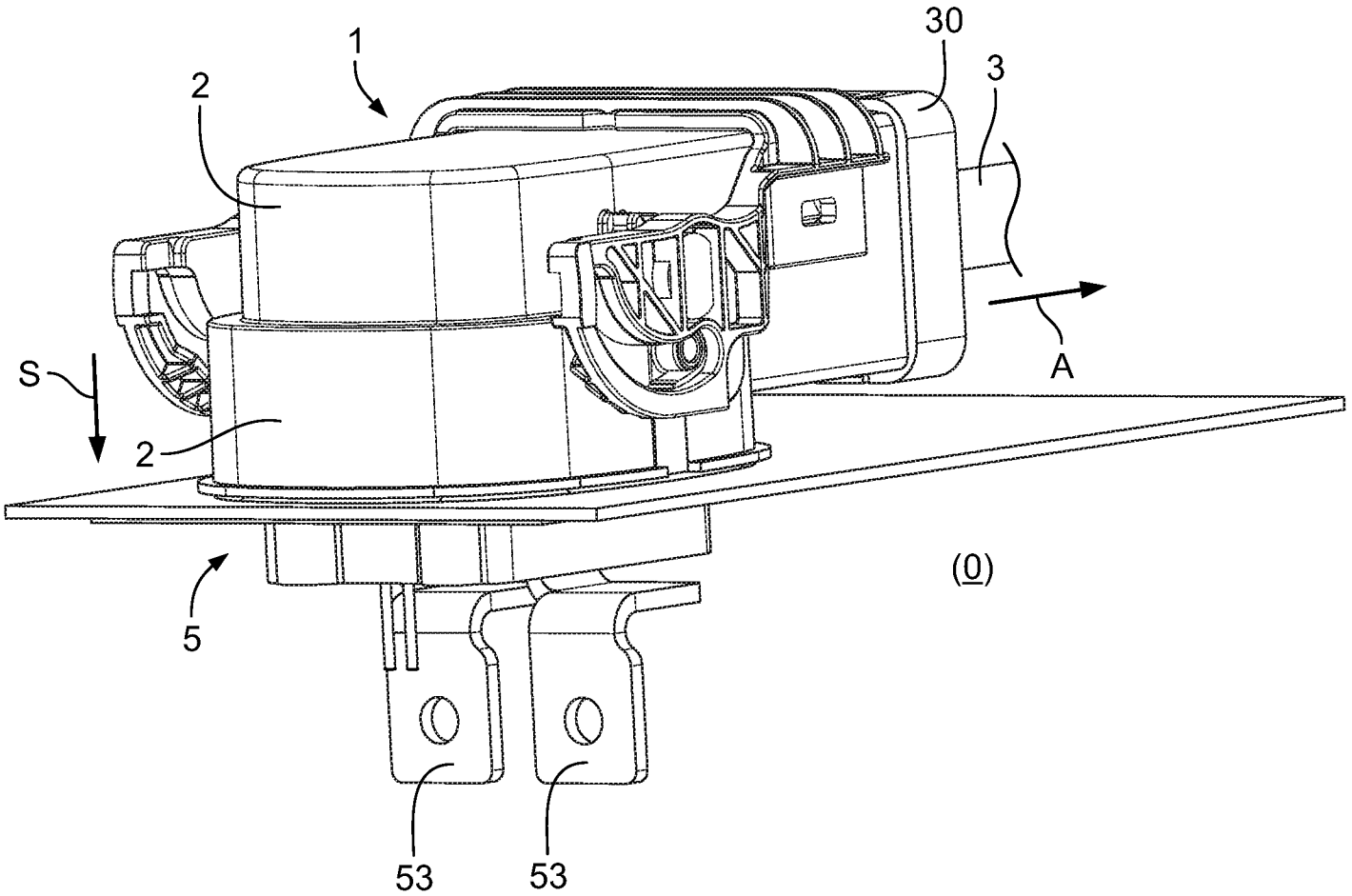
FIG. 1 is perspective view of a connector according to the invention in a mated state with a mating connector.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

A connector 1 according to the invention is shown generally in FIG. 1. The connector 1 is part of a device 0, and may be a high-voltage electrical connector of a motor vehicle device, but as would be understood by one with ordinary skill in the art, could be used in a variety of applications. The connector 1 may be a straight-line or angled connector for an electrical low/medium/high-voltage or current connection. The connector 1 may be a plug connector, a bushing connector, a pin connector, a tab connector, a hybrid connector, a plug receptacle, a bushing receptacle, or other types of connectors known to those with ordinary skill in the art.

The connector 1, as shown in FIG. 1, is matable with a mating connector 5. In the shown embodiment, the connector 1 and the mating connector 5 are a plug-bushing pair, but the connector 1 and mating connector 5 may have any complementary structures.

Figure 2:
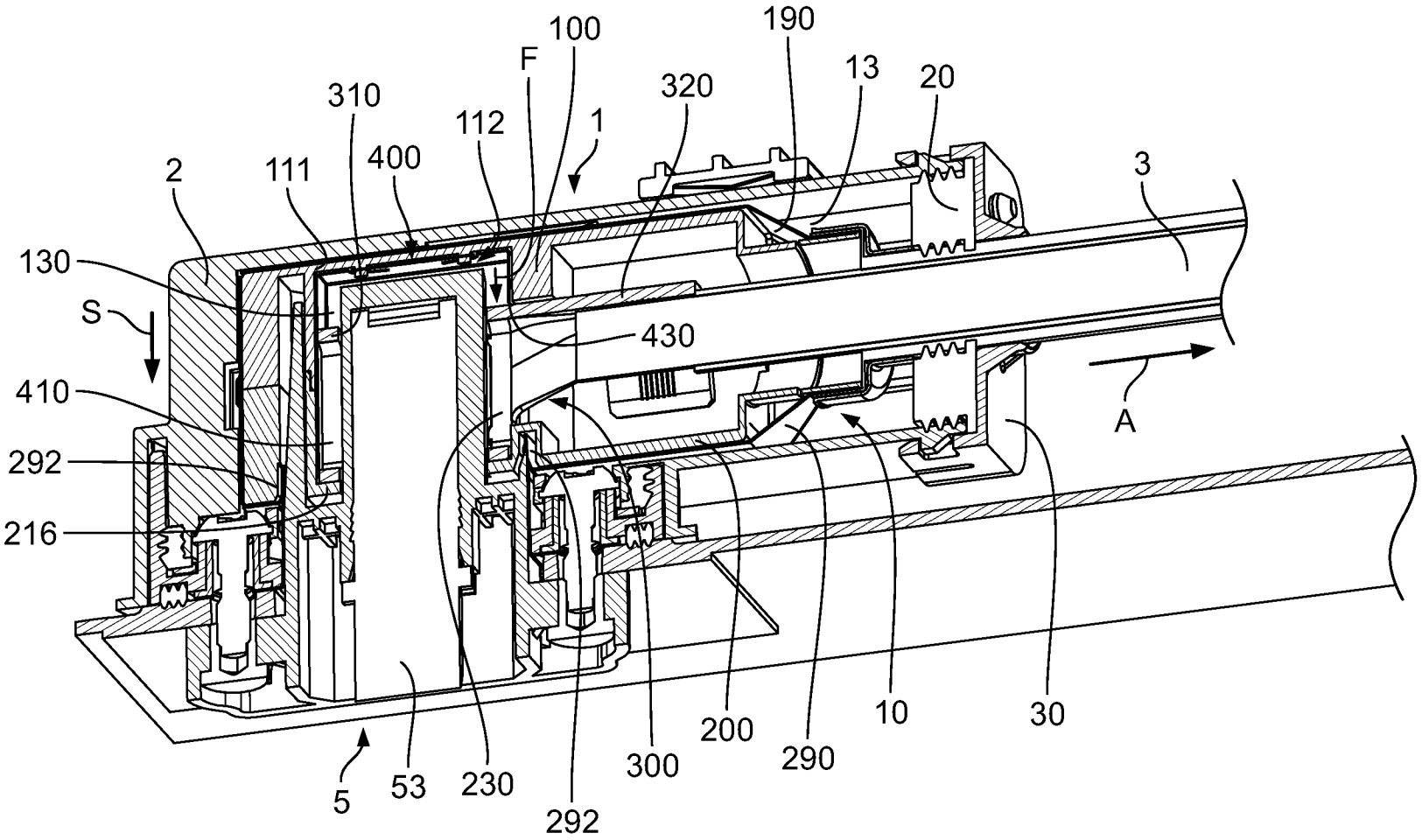
FIG. 2 is a sectional view of the connector and the mating connector of FIG. 1.

The connector 1 has an outer housing 2 and a contact assembly 10. The outer housing 2, as shown in FIG. 2, has two housing contact chambers 13. One contact assembly 10 is positioned in each housing contact chamber 13.

Figure 3:
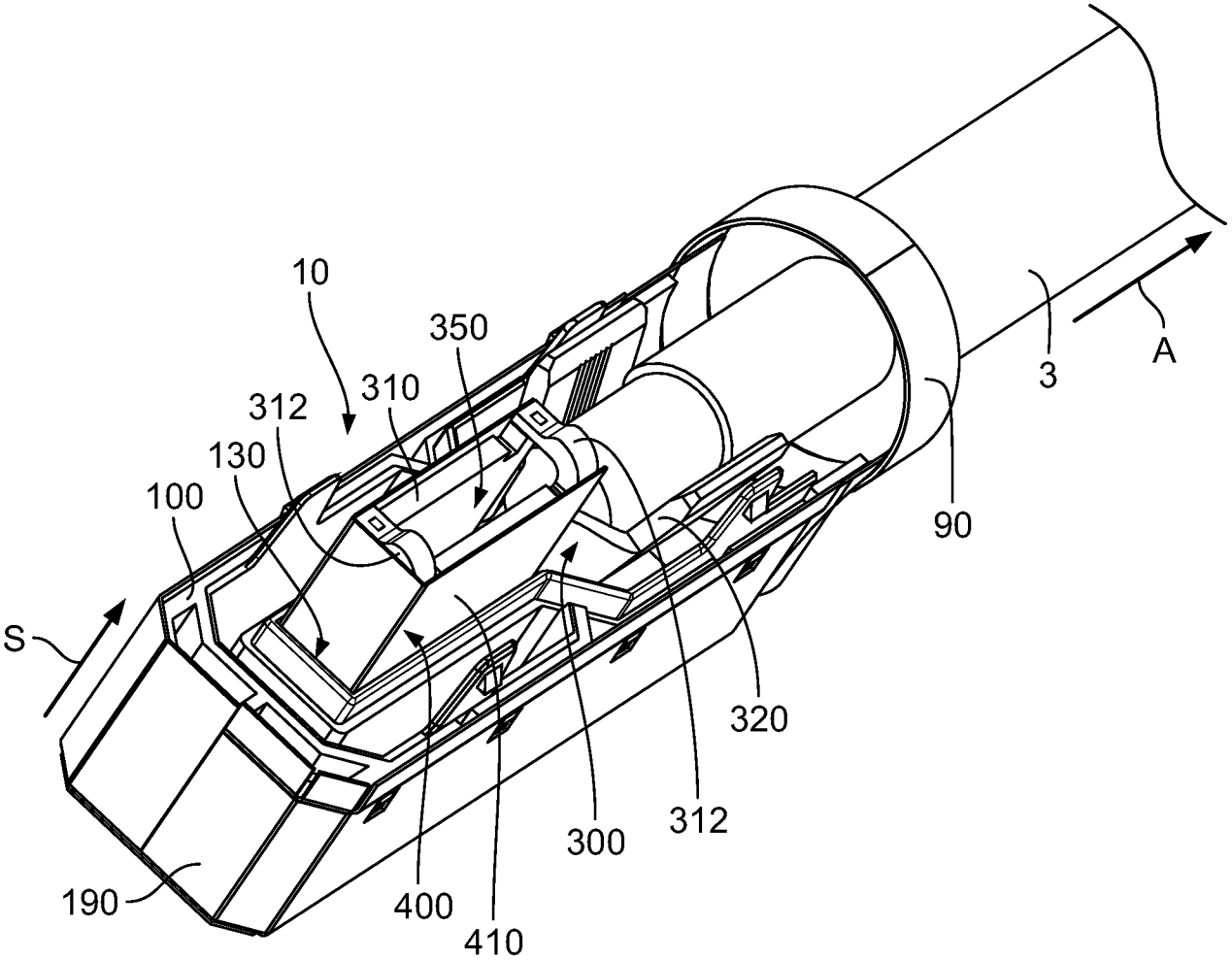
FIG. 3 is a bottom view of a contact assembly of the connector of FIG. 1.
Figure 4:
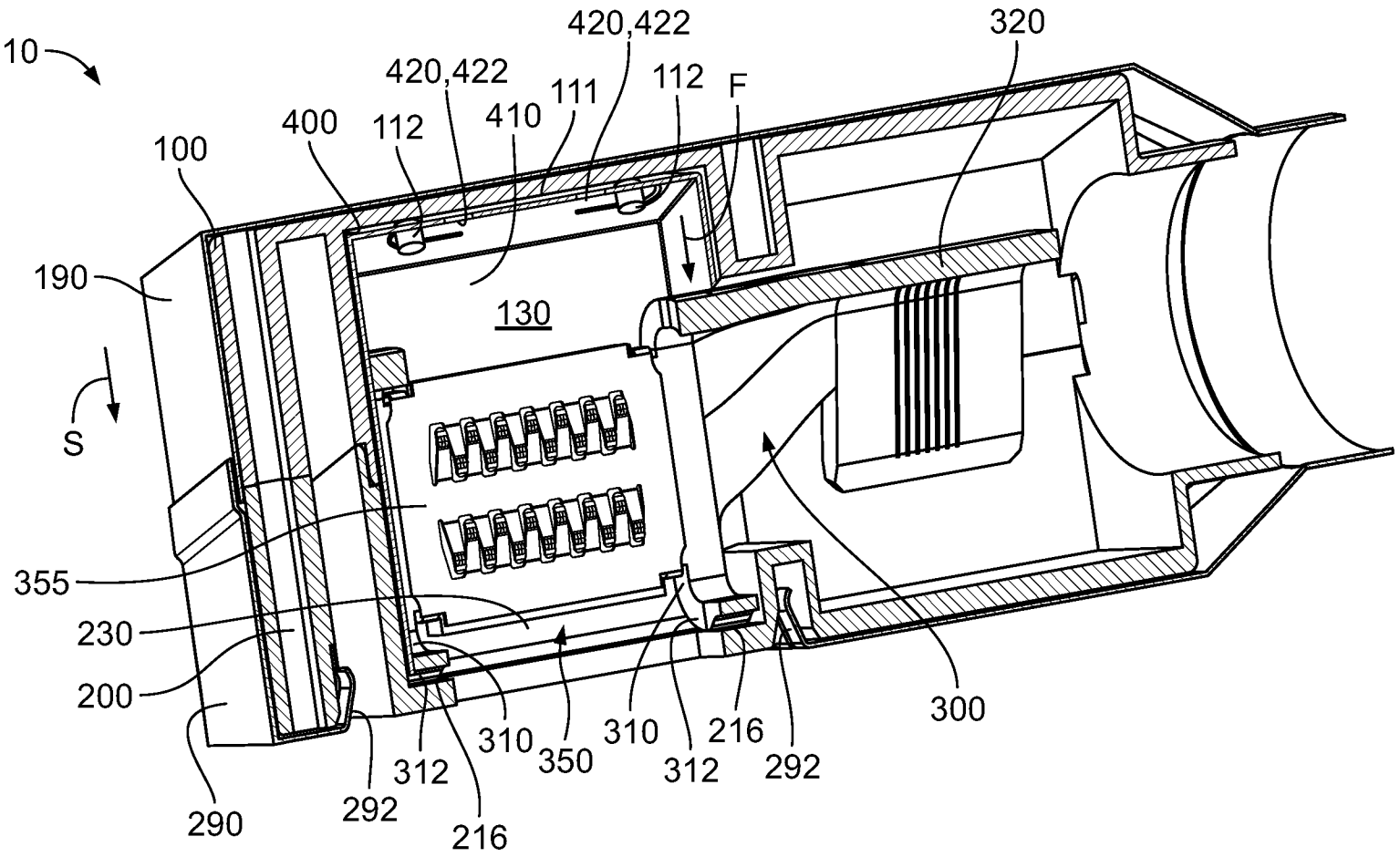
FIG. 4 is a sectional side view of the contact assembly of FIG. 3.
Figure 5:
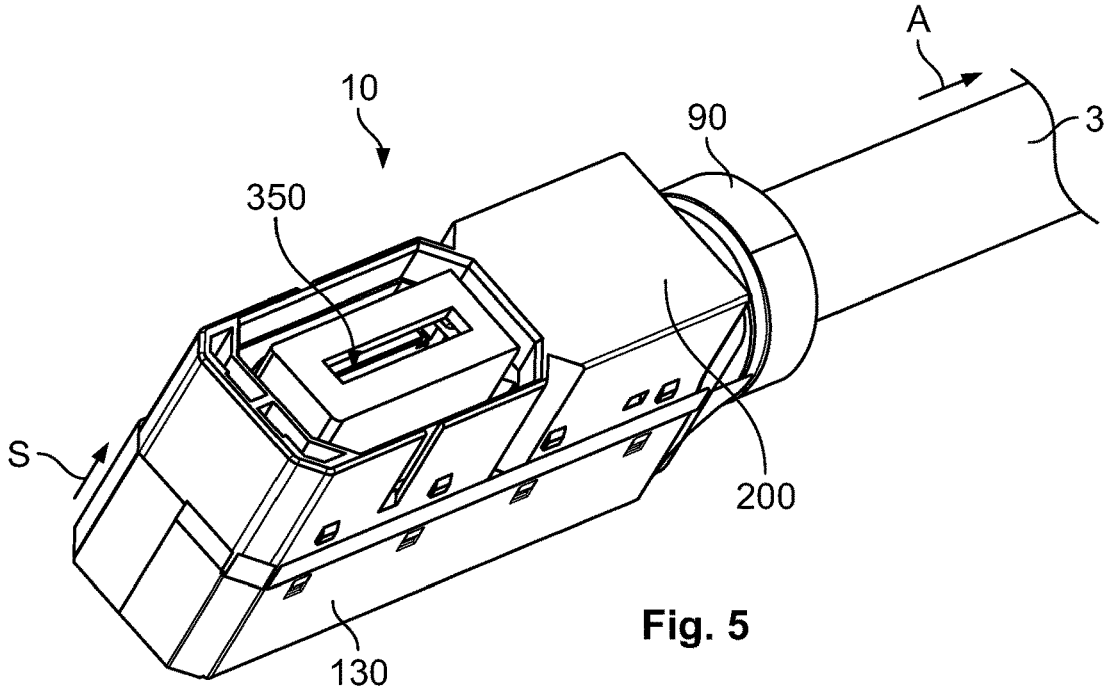
FIG. 5 is a bottom view of a contact assembly of FIG. 3 with a lower housing.
Figure 6:
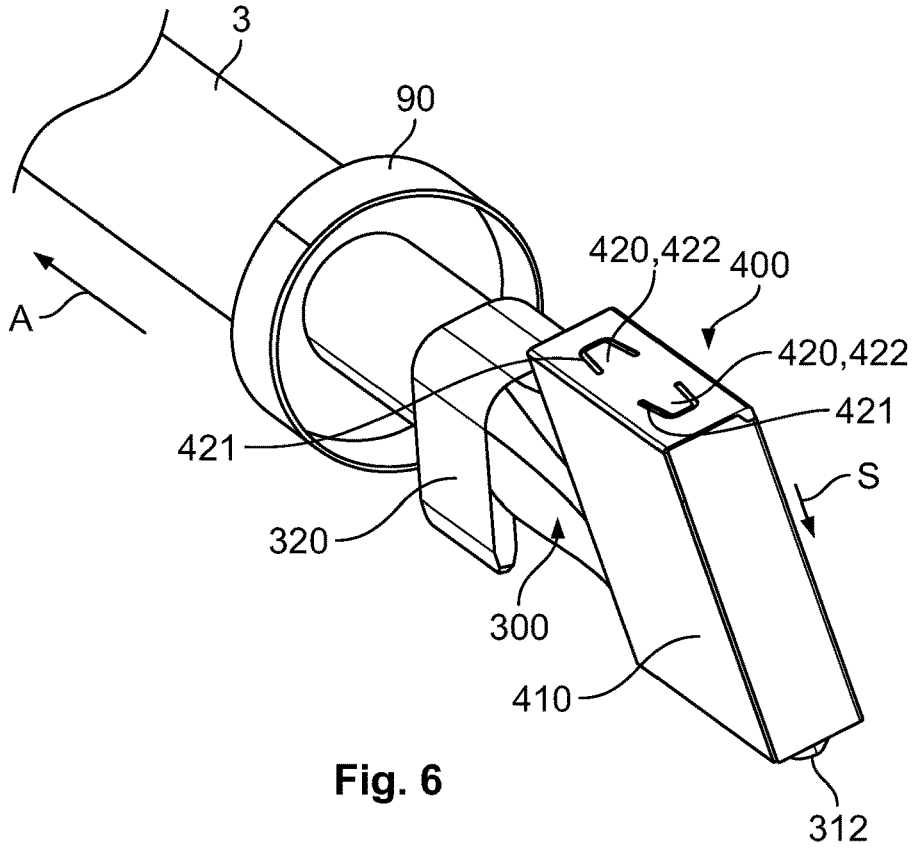
FIG. 6 is a perspective view of a contact and a contact stop spring of the connector of FIG. 1.

The contact assembly 10, as shown in FIGS. 3-5, has a contact housing 100, 200 with an upper housing 100 and a lower housing 200. In an assembled state, as shown in FIG. 4, the upper housing 100 and lower housing 200 form a contact chamber 130, 230 in which a contact section 310 of a contact 300 is disposed. The contact section 310 may be a bushing. A crimping section 320 of the contact 300 is disposed in a second cavity of the contact assembly 10. The second cavity, as shown in FIG. 4, is connected to the contact chamber 130, 230.

As shown in FIG. 3, an electrical line 3 is attached to the contact 300 by crimping in the crimping section 320. An outgoing side of the line 3 (outgoing direction A), as shown in FIGS. 2 and 3, is sealed with respect to the housing 2 by a seal 20 and the housing 2 is closed by a cover 30.

The contact housing 100, 200, as shown in FIGS. 2-4, is surrounded by a shield 190, 290 which comprises an upper shield 190 and a lower shield 290 overlapping in a circumferential direction (perpendicular to a plug-in direction S of the connector 1) around the contact assembly 10 at least in sections. In a region of the lower housing 200, the lower shielding casing 290 is open and has inwardly pointing shielding springs 292. The upper shield 190 and the lower shield 290 are electrically connected with a shield 90 of the electrical line 3.

A mating contact 53, as shown in FIG. 2, configured as a pin or tab contact 53 of the mating connector 5, is inserted into the contact 300 in a mating state of the connector 1 and the mating connector 5. In the mating state of the connector 1 and a mating connector 5 a shield of the mating connector 5 electrically contacts the shielding springs 292.

The contact section 310 is disposed within the contact chamber 130, 230 of the contact assembly 10, such that a mating contact receptacle 350 of the contact section 310 can receive the mating contact 53, as shown in FIGS. 2-4. For good electrical contacting between the contact 300 and the mating contact 53, an electromechanical contact disc 355 with contact spring arms and/or contact spring fins 355 is disposed inside on a side wall in the mating contact receptacle 350.

The contact section 310 is stopped in the plug-in direction S of the connector 1 in the contact chamber 130, 230, or is seated through a resilient force F in the contact chamber 130, 230. The following comments relate to the contact section 310 of the contact 300, but can similarly relate to the entire contact 300.

The resilient force F is exerted by a contact stop spring 400 onto the contact section 310 in at least one location of the contact section 310, as shown in FIG. 4. In this case, the contact section 310 is received in the contact stop spring 400 which is disposed in the contact chamber 130, 230. The contact stop spring 400 is substantially form-fit in the contact chamber 130, 230, and substantially fills the contact chamber 130, 230, apart from open sides of the contact stop spring 400 and a gap over a front end wall 411 with a spring device 420. The contact stop spring 400 also does not fill over a base 216 of the contact chamber 130, 230 due to projections 312 of the contact section 310. The resilient force F from the contact stop spring 400 acts in a region between the contact section 310 and the crimping section 320 counter to the plug-in direction S. The contact stop spring 400 may also engage the contact 300 at the free end of the contact section 310. In the embodiment, it would be possible, for example with a inwardly pointing notch of the contact stop spring 400, to load the free end of the contact section 310 with a resilient force. In this case, the notch itself can in turn be configured as a spring device or a spring arm.

Figure 7:
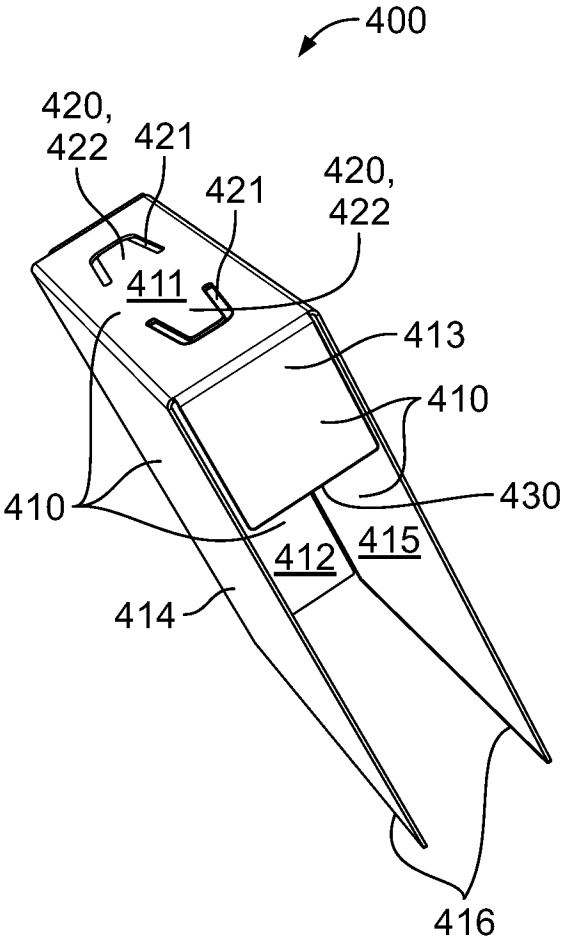
FIG. 7 is a perspective view of the contact stop spring of FIG. 6.

The contact section 310 is received in the contact stop spring 400 such that the contact stop spring 400 to a certain extent inhibits a movement of the contact section 310 counter to the plug-in direction S and stops the contact section 310 in a resilient manner in the contact chamber 130, 230. For this purpose, the contact stop spring 400 is situated with a resilient section configured as a resilient edge 430, as shown in FIG. 7, on top and on the outside between the contact section 310 and the crimping section 320. The contact section 310 is situated substantially opposite on the base 216 of the contact chamber 130, 230 or a base wall 216 of the lower housing 200. The contact section 310 is clamped between the resilient edge 430 and the base 216.

Since the contact stop spring 400 cannot be fitted sufficiently precisely into the contact chamber 130, 230 with acceptable tolerances, the contact stop spring 400 itself is situated resiliently held in the contact chamber 130, 230, between the contact section 310 and a cover 111 of the contact chamber 130, 230 or a cover wall 111 of the upper housing 100. The resilient holding results from the spring device 420, as shown in FIGS. 4 and 7, positioned between a stop body 410 of the contact stop spring 400 and the cover 111 of the upper housing 100. The spring device 420 may alternatively be provided as an independent structural element and/or on the cover 111.

Figure 8:
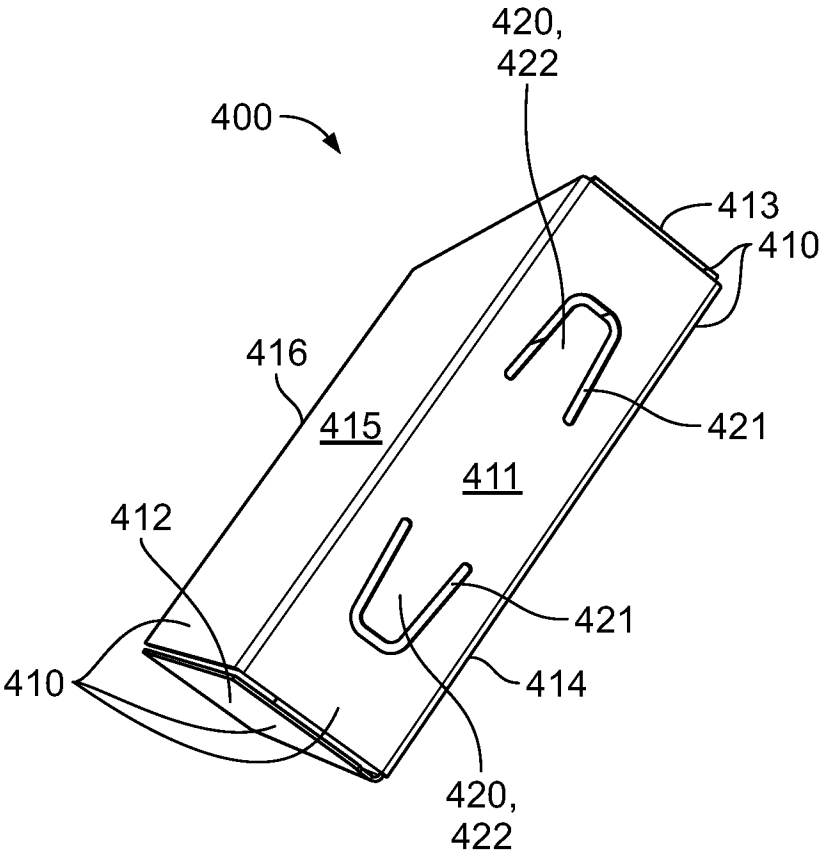
FIG. 8 is a top view of the contact stop spring of FIG. 6.

As shown in FIGS. 7 and 8, the spring device 420 is formed in the planar front end wall 411 of the contact stop spring 400 in the contact stop spring 400. A U-shaped slot 421 in the front end wall 411 forms the spring device 420 by cutting a spring arm 422 of the spring device 420 from the front end wall 411. In an embodiment, two such spring arms 422 are disposed in the front end wall 411. In a mounted state, shown in FIG. 4, an actuation projection 112 on the cover 111 of the contact chamber 130, 230 presses on the respective spring arm 422 and the spring arms 422 press the stop body 410 against the contact section 310, the crimping section 320 or a transition region between the contact section 310 and the crimping section 320.

The contact stop spring 400, as shown in FIGS. 7 and 8, is substantially box-shaped. The contact stop spring 400 is made of metal and may be stamped out of a single stamping blank and bent into shape. The contact stop spring 400 may alternatively be formed of other elastically deformable materials such as rubber or plastic. The contact stop spring 400, starting from the front end wall 411 downwards, comprises a comparatively long longitudinal side wall 412, two transverse side walls 414, 415 and a comparatively short longitudinal side wall 413. The two spring devices 420 are disposed in the front end wall such that, in an unstressed state, the two spring devices 420 do not project inwards or outwards from the front end wall 411. In a stressed state, the two spring devices 420 protrude from the front end wall 411 inwards into the contact stop spring 400 or the stop body 410. Furthermore, the comparatively short longitudinal side wall 413 or the free end thereof forms the resilient section 430 or the resilient edge 430 of the contact stop spring 400. The contact stop spring 400 has a narrow front end wall 411 as a substantially closed side aside from the slots 421, a narrow and comparatively long longitudinal side wall 412 as a substantially closed side, a narrow and comparatively short longitudinal side wall 413 as a partially open side, and the two wide transverse side walls 414, 415, as substantially closed sides. At the side opposite the narrow front end wall 412, the contact stop spring 400 or the stop spring 400 has an open front end 416. The contact stop spring 400 can be assembled or formed integrally.

In an assembled state, as shown in FIGS. 2 and 4, the contact section 310 is received in the contact stop spring 400, with at least one projection 312 of the contact section 310 protruding through and below the contact stop spring 400, which is open there. The contact 300 extends with its crimped section 320 out of the laterally open contact stop spring 400 beneath the comparatively short longitudinal side wall 413, wherein this longitudinal side wall 413 is seated with its free end as a resilient edge 430 on top of the contact section 310 and in the assembled state presses this onto the base 216.

The contact section 310 with the contact stop spring 400 located above it is received in the contact chamber 130, 230, wherein the actuation projections 112 on the cover 111 press the spring devices 420, the spring devices 420 press the stop body 410, and the stop body 410 presses, with its resilient edge 430, the contact section 310 and the crimped section 320. The spring devices 420 press the contact section 310 in the direction of the base 216 on which the contact section 310 rests by its projections 312 which protrude out of the contact stop spring 400. The projections 312 could alternatively be part of the base wall 216.

The contact 300 may be similarly stopped or braced in the contact chamber 130, 230 not only in the plug-in direction S but, additionally or alternatively, in at least one other spatial direction, such as an outgoing direction A of the electrical line 3.

Advantageously, the contact stop spring 400 of the invention is configured such that the stop body 410 engages the contact 300 and the spring device 420 can be actuated by the connector 1. As a result, the contact 300 is pushed by the stop spring 400 against a wall of the contact chamber 130, 230 and cannot move in the contact chamber 130, 230. Forces imparted by a moving electrical line 3 are therefore compensated by the stop spring 400, leading to a more reliable electrical connection formed by the contact 300.

What is claimed is:

1. A contact stop spring, comprising:

a stop body substantially box-shaped having a resilient section formed on a short longitudinal side wall and a long longitudinal side wall positioned opposite the short longitudinal side wall; and a spring device formed on a front end wall of the stop body, the front end wall extends perpendicular to the short longitudinal side wall and the long longitudinal side wall, the spring device pressing the resilient section and the resilient section applying a resilient force to a contact disposed in a contact chamber of a connector, the contact protruding from a side of the stop spring under the resilient section.

2. The contact stop spring of claim 1, wherein the resilient section of the stop body engages the contact, the resilient section oriented perpendicular to the spring device.

3. The contact stop spring of claim 1, further comprising two spring devices.

4. The contact stop spring of claim 3, wherein the contact stop spring is integrally formed of a metal material.

5. The contact stop spring of claim 1, wherein the spring device is formed in a planar wall of the stop body and the resilient section is an outer edge of the stop body.

6. The contact stop spring of claim 5, wherein a U-shaped slot in the planar wall forms a spring arm of the spring device.

7. A contact assembly, comprising:

a contact housing having a contact chamber; and a contact held in the contact chamber by a contact stop spring having:

a stop body substantially box-shaped, a short longitudinal side wall, a long longitudinal side wall positioned opposite the short longitudinal side wall, and a resilient section located to exert a resilient force on the contact which protrudes from a side of the contact stop spring opposite the resilient section.

8. The contact assembly of claim 7, wherein the contact is a bushing.

9. The contact assembly of claim 7, wherein the contact stop spring is substantially form-fit in the contact chamber.

10. The contact assembly of claim 7, wherein the contact is resiliently held in the contact chamber in a plug-in direction and in a direction counter to the plug-in direction.

11. The contact assembly of claim 10, further comprising an electrical line connected to the contact.

12. The contact assembly of claim 11, wherein the contact is resiliently held in the contact chamber in an outgoing direction of the electrical line and in a direction counter to the outgoing direction of the electrical line.

13. The contact assembly of claim 7, wherein the contact stop spring is disposed between a cover wall of the contact housing and the contact.

14. The contact assembly of claim 13, wherein a free end of the contact is received in the contact stop spring.

15. The contact assembly of claim 14, wherein a spring device of the stop spring exerts the resilient force, the spring device actuated by an actuation projection of the cover wall.

16. A motor vehicle device, comprising:

a contact assembly having a contact housing with a contact chamber and a contact resiliently held in the contact chamber by a contact stop spring, the contact stop spring having a stop body substantially box-shaped, a short longitudinal side wall, a long longitudinal side wall positioned opposite the short longitudinal side wall, and a resilient section exerting a resilient force on the contact, the contact protruding from a side of the contact stop spring opposite the resilient section.

* * * * *